US007823315B2

(12) United States Patent
Webber et al.

(10) Patent No.: US 7,823,315 B2
(45) Date of Patent: Nov. 2, 2010

(54) METHOD AND APPARATUS FOR EASY CONNECT STOCKS

(75) Inventors: Kevin A. Webber, Deerfield, NH (US); Sean P Toner, Brookline, NH (US); Joseph A. Hoell, Jr., Dunbarton, NH (US); Thomas C. Lynch, Wallingford, CT (US)

(73) Assignee: O.F. Mossberg & Sons, Inc., North Haven, CT (US)

( * ) Notice: Subject to any disclaimer, the term of this patent is extended or adjusted under 35 U.S.C. 154(b) by 0 days.

(21) Appl. No.: 12/625,785

(22) Filed: Nov. 25, 2009

(65) Prior Publication Data

US 2010/0132240 A1 Jun. 3, 2010

Related U.S. Application Data

(63) Continuation-in-part of application No. 11/551,271, filed on Oct. 20, 2006.

(60) Provisional application No. 60/729,145, filed on Oct. 20, 2005.

(51) Int. Cl.
*F41A 21/00* (2006.01)

(52) U.S. Cl. ..... 42/75.03; 42/71.01; 42/72

(58) Field of Classification Search ..... 42/71.01–74, 42/75.03

See application file for complete search history.

(56) References Cited

U.S. PATENT DOCUMENTS

| | | | | |
|---|---|---|---|---|
| 3,961,436 | A | 6/1976 | Hagen et al. | |
| 4,328,633 | A | 5/1982 | Pachmayr | |
| 4,691,462 | A * | 9/1987 | Mattarelli | 42/75.04 |
| 5,173,564 | A | 12/1992 | Hammond, Jr. | |
| 5,305,539 | A | 4/1994 | Kuster | |
| 5,711,102 | A | 1/1998 | Plaster et al. | |
| 6,374,528 | B1 | 4/2002 | Davis et al. | |
| 6,622,412 | B1 | 9/2003 | Wilkes | |
| 6,874,269 | B2 | 4/2005 | Chen et al. | |
| 6,889,463 | B2 | 5/2005 | Orth | |
| 7,162,822 | B1 * | 1/2007 | Heayn et al. | 42/73 |
| 7,162,823 | B2 | 1/2007 | Schoppman et al. | |
| 7,685,757 | B2 * | 3/2010 | Rohrauer | 42/75.01 |
| 2003/0029070 | A1 * | 2/2003 | Dowding | 42/75.03 |
| 2007/0214697 | A1 * | 9/2007 | Ochoa | 42/73 |
| 2009/0019757 | A1 * | 1/2009 | Moretti | 42/75.03 |

* cited by examiner

*Primary Examiner*—J. W Eldred
*Assistant Examiner*—Gabriel J Klein
(74) *Attorney, Agent, or Firm*—Holland & Bonzagni, P.C.; Donald S. Holland, Esq.

(57) ABSTRACT

A method and apparatus are disclosed for substituting a different stock, or a different receiver assembly, in a long gun (e.g., a shotgun) without the use of tools by a user in the field. Applicants' preferred apparatus comprises: a long gun (e.g., an illustrated shotgun) having a stock and a receiver assembly; and an adaptor assembly which removably interconnects the stock to the receiver assembly, wherein the adaptor assembly includes: an adaptor base affixed to the receiver; an end of the stock is mounted onto the adaptor base; and a rotatable locking pin, continuously attached to the base, which can be lifted up and rotated or turned on its axis by 90° to unlock the adaptor assembly. The stock can then be pulled off the adaptor base. Upon a new stock being mounted on the adaptor base, the locking pin can be rotated back to its original orientation and pushed down to lock the adaptor assembly, whereupon the adaptor assembly interconnects the substitute stock with the receiver assembly. While Applicants' locking pin can rotate and move up-and-down, it is always maintained within the adaptor assembly, even throughout the entire process of swapping a different stock.

10 Claims, 4 Drawing Sheets

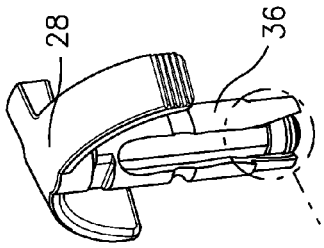
FIG. 8
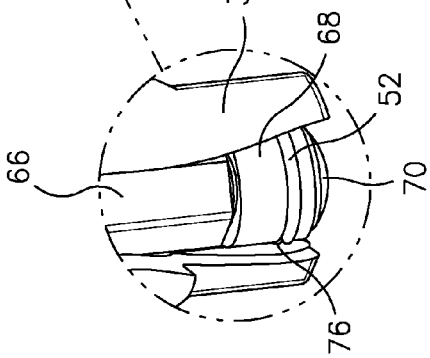
FIG. 8A
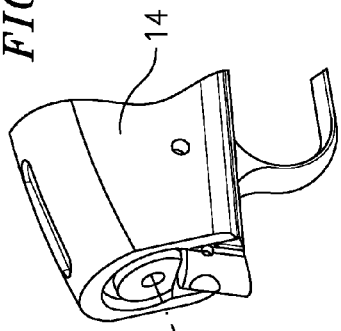
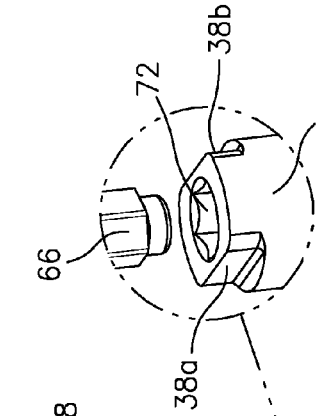
FIG. 7B
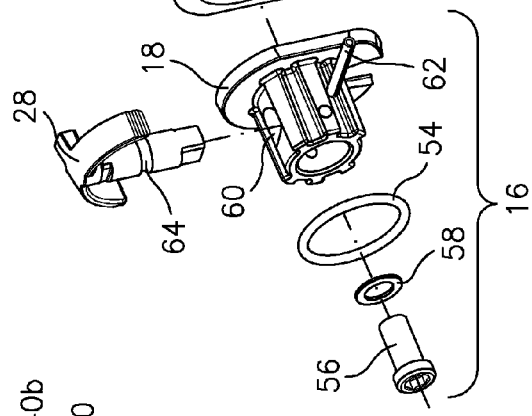
FIG. 6
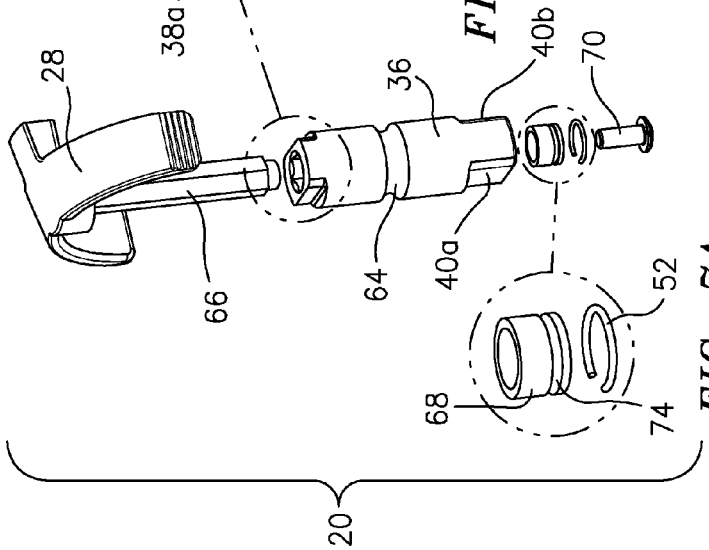
FIG. 7
FIG. 7A

METHOD AND APPARATUS FOR EASY CONNECT STOCKS

RELATED APPLICATIONS

This is a continuation-in-part application of U.S. Utility patent application Ser. No. 11/551,271, filed Oct. 20, 2006, which was based upon a U.S. Provisional Patent Application Ser. No. 60/729,145, filed Oct. 20, 2005. Applicants hereby claim under 35 U.S.C. §§119(e), 120 the benefit of priority from those prior applications. Applicants hereby incorporate the disclosures of Applicants' Parent Application and Applicants' Provisional Application by reference in their entireties.

FIELD OF INVENTION

This invention relates generally to firearms. More specifically, it relates to stocks and forends in long guns, such as shotguns.

BACKGROUND

A long gun is a firearm with an extended barrel, usually designed to be fired braced against the shoulder. Barrels of such weapons commonly extend to around 50 cm or longer, giving considerable accuracy and range. Most modern long guns fall into one of two categories, rifles or shotguns, distinguished by their design and type of projectile they fire.

Shotguns are designed primarily to fire small pellets, called shots. Some shotguns can be adapted to fire a single projectile, called a slug.

There are several major components of shotguns: the barrels, stocks, and forends or forearms. Shotguns are distinguished by the length of their barrels, and by their barrel diameters, or bores. The barrels, stocks, and forends vary according to the gun's design and intended use.

By far the most common gauges for barrels are 12 (0.73 in, 18.5 mm diameter) and 20 (0.614 in, 15.6 mm), although 4, 8, 10, 14, 16, 24, 28, 32 gauges and the .410 calibre (10 mm) have also been produced.

Chokes on the barrels can control the exiting spread, or pattern of shot. Therefore, shotgun gauges and choke patterns are selected based on the type of shooting to be done.

The proper fit for a user of a shotgun depends largely on the length and shape of the gun's stock. The selection of the proper stock and forend will have a bearing on the user's comfort, accuracy, and control when shooting.

The gauge of a barrel and the type of game are factors in determining what ammunition is to be used. Pump shotguns intended for private defensive use have barrels as short as 18 inches. "Small game" barrels, for hunting game like rabbits and squirrels with buckshot, are often 22 to 24 inches in length. Larger barrels, about 28-29 inches, are used to hunt quails, pheasants, and doves in semi-open wooded or farmland, where dense brush is less of a hindrance and the ability to have more reach is important. Still other barrels, designed for single shot, are used for hunting larger game.

The advent of interchangeable barrels made the shotgun a more versatile firearm, especially in the field. Hunters often swap out barrels for different game.

Shotguns also are used for sports such as skeet, trap, and sporting clays. These involve shooting clay disks, known as clay pigeons, thrown in various ways. Shorter stocks are used for greater maneuverability.

Often, shooters will want to change the forend and or stock to create the proper fit. This happens, sometimes, when there are two shooters (e.g., a husband and wife) sharing the same shotgun. One of the shooters will, more than likely, have an improper fit with the shotgun.

Another instance is with hunters. Often, the hunter will want to switch out the forend and stock to create the proper fit for different game or sporting activity.

The changing of the stock, forend, or both is a time-consuming process. The user has to disassemble portions of the shotgun by using tools when in the field. If the stock is too long, it can get caught in the armpit of the user. If the stock is too short, recoil can cause the scope to hit the eyebrow. An improper fit can also cause during the gun's recoil: the stock to hit the cheek, when the cheek is pressed on the stock to line up the sight and target.

The average woman typically uses a shorter stock than the average man. Forearms have an ergonomic design for comfort, fit and control. Shotgun stocks and forends come in a variety of designs and materials. Selections of the stock and forend will depend upon what the shooter is comfortable with and the use.

To remove existing shotgun stocks, the butt pad has to be taken off first. This requires the user to unscrew the Philips screws holding it in place. Upon removal of the pad, the stock bolt and any metal spacers have to be removed to free the stock from the shotgun or the receiver. The forend currently is either slid onto the magazine tube or over both the magazine tube and barrel.

Some shotgun designs have a screw or another form of locking mechanism for the forend.

U.S. Pat. No. 6,374,528 to Davis et al. discloses a stock mounting kit that uses adaptors. U.S. Pat. No. 5,173,564 to Hammond, Jr. discloses a stock mounting kit using an extension and latch system. Both of these inventions require the use of tools in the field to swap out stocks.

U.S. Pat. No. 7,162,823 to Schoppman et al. ("Schoppman") discloses a connector for swapping stocks of firearms in the field without specialized tools. Schoppman's depicted connector embodiments are held together by an engagement lug (see FIG. 1 in Schoppman) or by a pull ring (see FIG. 10 in Schoppman). For disassembly, the lug and pin are each designed to be removed entirely from an aligned aperture in a "front" or "first" connector, which is affixed to a receiver of a firearm, to release the connector from a "rear" or "second" connector which is affixed to a firearm stock. Then the engagement lug or pull ring is kept apart from the second connector until an identical second connector, affixed to a different or substitute stock, is slipped into the first connector to form a newly aligned recess or bore. Afterwards, the lug or ring is reinserted into the newly aligned recess. Accordingly, it appears that Schoppman's lug is neither designed nor intended to be retained always within Schoppman's adaptor base.

Applicants have a pending U.S. patent application Ser. No. 11/551,271, entitled "EASY CONNECT STOCK AND FOREND SYSTEM", and filed Oct. 20, 2006. That application, published as U.S. Patent Application Publication No. 2007/0089347, discloses a pre-production model. The current application depicts an improved production model. O.F. Mossberg and Sons, Inc. ("Mossberg") is the Assignee of both applications.

Accordingly, it is a general object of the present invention to provide an improved method and apparatus which permit the quick and easy change of shotgun stocks and forends without the use of tools in the field.

It is another general object to provide an improved connect/disconnect system which permits the quick and easy change of stocks and forends, for any long gun, without the use of tools in the field.

It is a more specific object to provide an improved adaptor assembly for removably interconnecting a stock to a receiver, wherein the adaptor has a tool-less release for changing stocks without the use of tools in the field.

It is another specific object to provide an easy connect/disconnect system for long-gun forends that permits a shooter to attach a different forend without the use of tools.

SUMMARY OF INVENTION

A method and apparatus are disclosed for easily and quickly replacing a stock or forend (a.k.a. forearm) of a long gun without the use of tools in the field. In the preferred embodiment, Applicants' apparatus comprises: a modified stock having a specially shaped (non-butt) end adjacent to a standard receiver assembly of a shotgun; an adaptor assembly, affixed to the receiver assembly, for removably interconnecting the stock to the receiver assembly; and the adaptor assembly has a tool-less, rotatable locking pin or actuator means which can be rotated or turned along its longitudinal axis by 90°, and then pushed down into a mating recess atop the stock, to lock both the adaptor assembly and the interconnection of the stock to the receiver assembly.

In the field a shooter can unlock the adaptor assembly without any tools to substitute or swap a different stock. This is achieved by lifting and rotating the locking pin/actuator means. Upon swapping out the new stock, the adaptor assembly can be locked again without any tools (i.e., by rotating the locking pin back and pushing it down), whereupon the receiver and new stock are secured together.

While Applicants' locking pin can rotate and move up-and-down, it is always maintained within an adaptor base of the adaptor assembly, even throughout the entire process of swapping a different stock.

BRIEF DESCRIPTION OF DRAWINGS

The above and other objects will become more readily apparent when the following description is read in conjunction with the accompanying drawings, in which:

FIG. 6 is an exploded view of an adaptor assembly, in Applicants' preferred embodiment, adjacent the receiver assembly;

FIG. 7 is an exploded view of Applicants' preferred locking pin/actuator means;

FIG. 7A shows a close-up of an encircled portion of FIG. 7;

FIG. 7B shows a close-up of an encircled portion of FIG. 7;

FIG. 8 shows the FIG. 7 parts assembled with portions broken away; and

FIG. 8A shows a close-up of an encircled portion of FIG. 8.

DETAILED DESCRIPTION OF THE PREFERRED EMBODIMENT

Figures 1, 2:
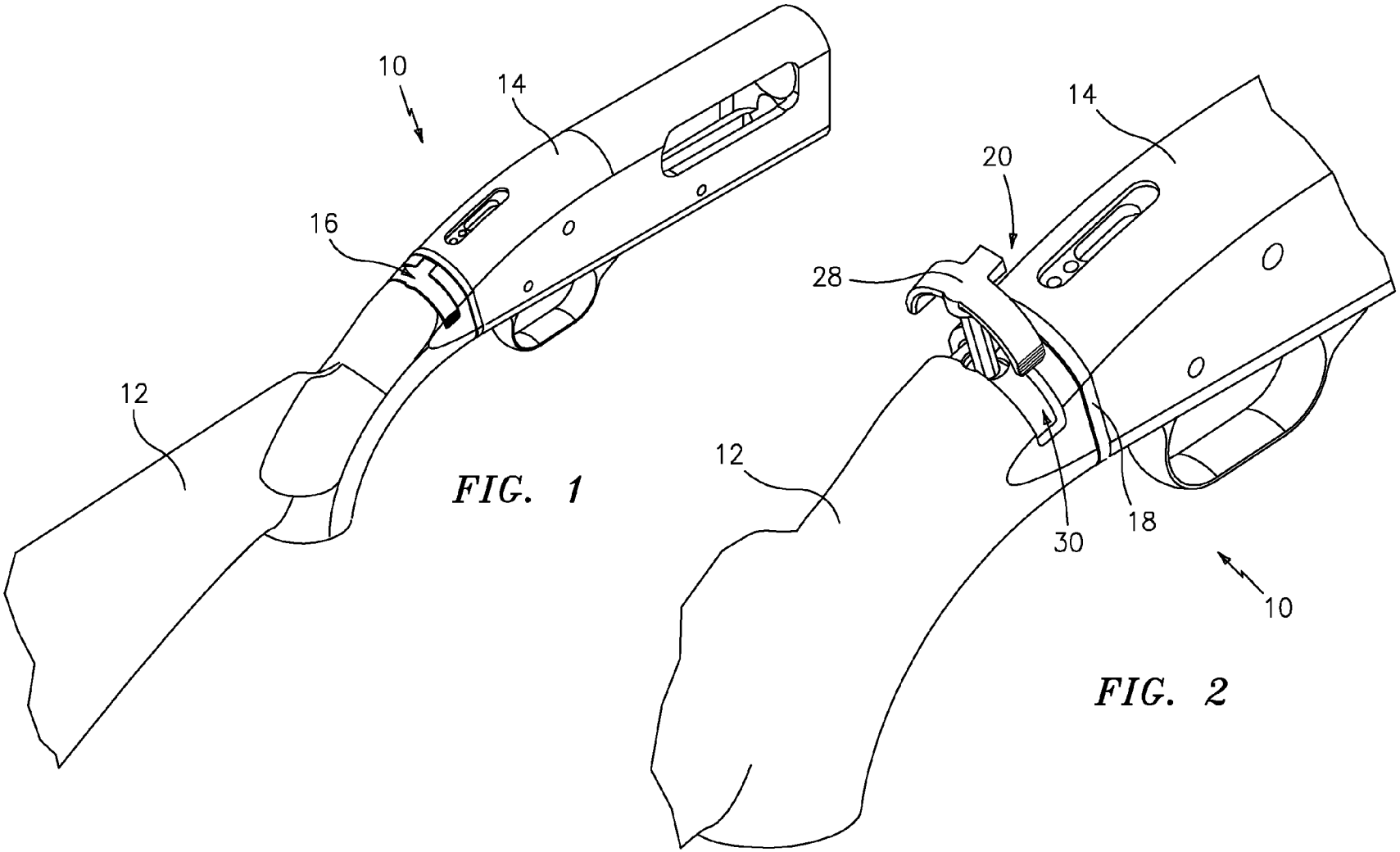
FIG. 1 depicts a top perspective view of a standard long gun (here, a shotgun), with portions broken away, utilizing a preferred embodiment of Applicants' "Easy Connect Stock" apparatus to removably interconnect a firearm stock to a receiver assembly.
FIG. 2 is another top perspective view, similar to FIG. 1, but depicting a tool-less locking pin or actuator means of Applicants' preferred embodiment in a lifted position.

Referring to the drawings in detail, FIGS. 1-8 depict a preferred embodiment 10 of Applicants' apparatus for easily connecting a stock to a forend (i.e., the receiver assembly) of a shotgun.

In the preferred embodiment 10, Applicants' apparatus comprises: a firearm stock 12; a forend or receiver assembly 14 (sometimes referred to as "receiver"); an adaptor assembly 16 to removably interconnect the stock 12 to the receiver assembly 14; the adaptor assembly 16 has an adaptor base 18, which is affixed (e.g., bolted or screwed) to a receiver assembly; a specially shaped, non-butt, stock end 19 which is removably mounted onto the adaptor base 18; and a rotatable locking pin or actuator means 20 for locking and unlocking the adaptor base 18, wherein the locking pin is continuously maintained within the adaptor base 18.

The term "stock", as used in this application, refers to any stock or pistol grip commonly used on long guns, such as a shotgun.

As best shown in FIGS. 4, 5, 5A and 6, the preferred connection between the stock 12 and receiver 14 is obtained via a splined union. Applicants' adaptor base 18 is affixed to the receiver 14, such as by bolt 23. When the stock 12 is pushed or mounted onto the adaptor base 18, a series of external splines 24 on the adaptor base 18 mates with a series of complementarily shaped internal splines 26 inside the specially shaped, non-butt, end 19 of stock 12 (see FIG. 4).

Adaptor assembly 16 can then be locked by the rotatable locking pin or actuator means 20. Locking pin 20 is designed to ride in, but always be attached to, adaptor base 18. The locking pin 20 has a T-shaped handle 28.

Figures 3, 4:
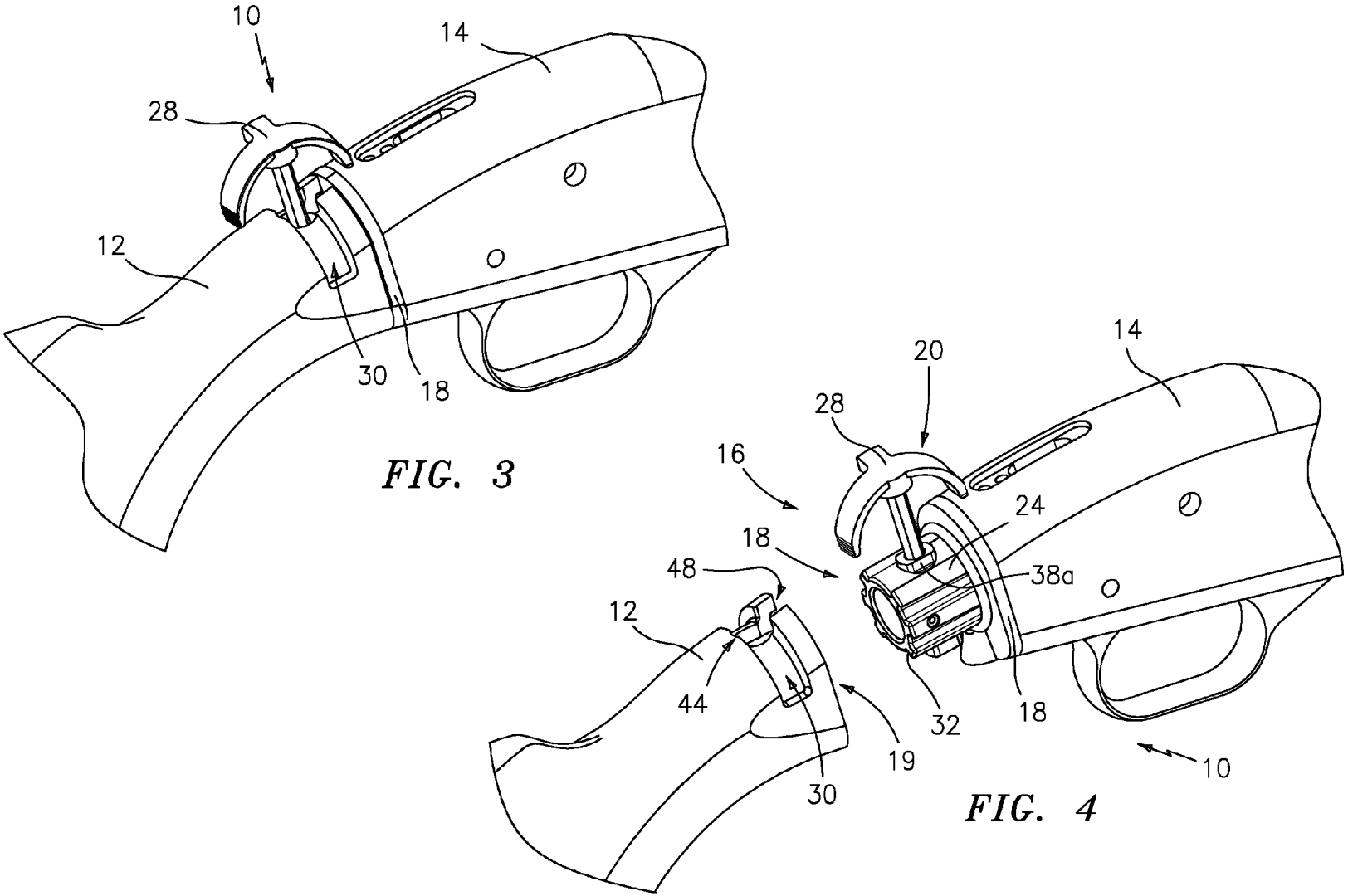
FIG. 3 is a similar perspective view to FIG. 2, but depicting the locking pin rotated by 90° to an unlocked position.
FIG. 4 is a top perspective view, wherein the stock and receiver assembly are disconnected with the tool-less locking pin in its unlocked position.
Figures 5, 5A:
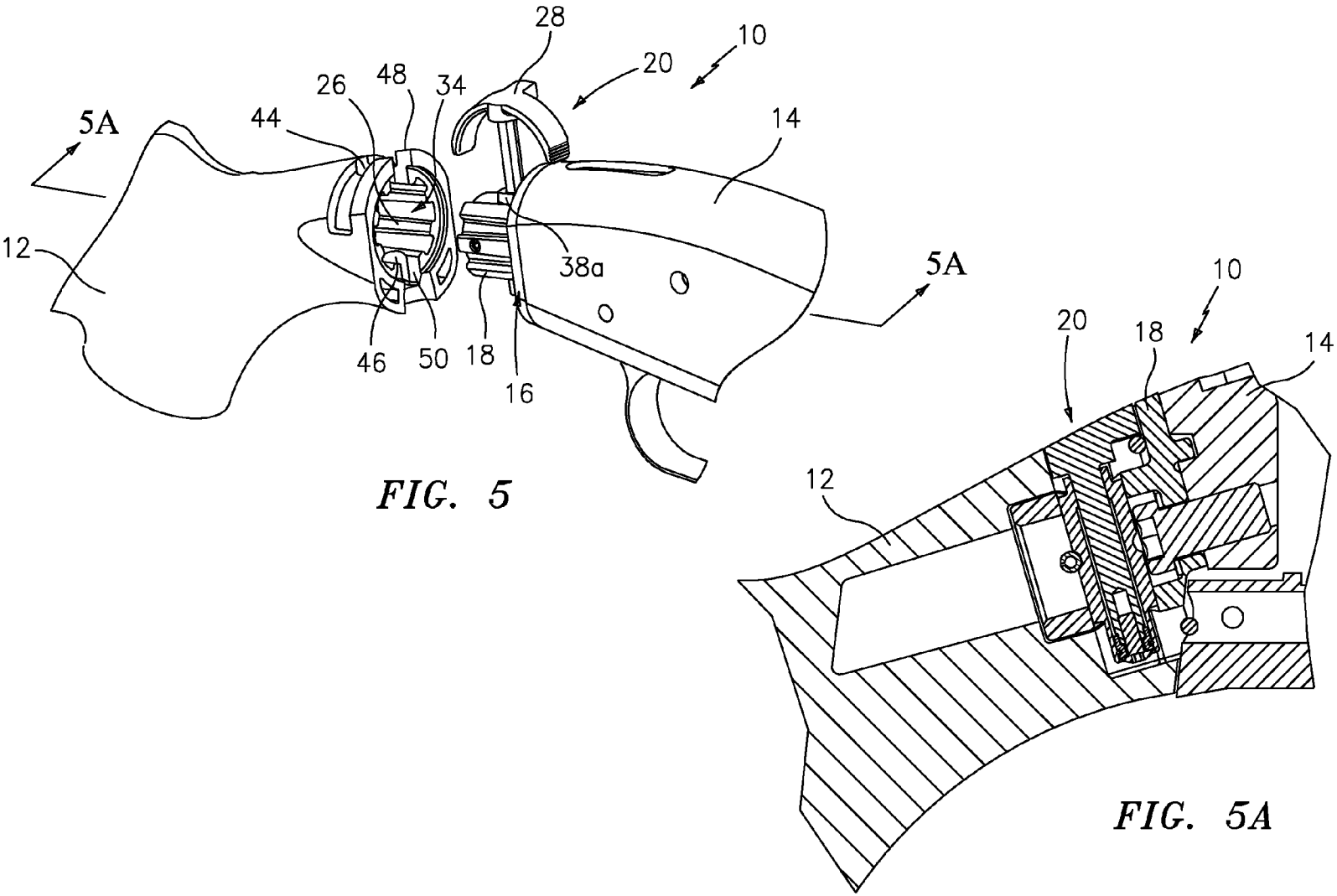
FIG. 5 is a top perspective view of Applicants' preferred embodiment, wherein the stock and receiver assembly are disconnected, showing a splined pocket inside a specialized stock end.
FIG. 5A is a cross-sectional view taken along sight line 5A-5A of FIG. 5, showing the stock and receiver assembly connected via Applicants' preferred embodiment.

As best shown in FIGS. 3-5, when the stock 12 is mounted onto the external splines 24, the adaptor assembly 16 is unlocked with its locking pin 20 (and T-shaped handle 28) raised. The T-shaped handle 28 is parallel to a longitudinal axis of the shotgun.

To then secure or lock the stock 12 in place (see FIGS. 1, 2 and 3), rotate or turn the locking pin 20 on its axis by 90°, until a vertical stem of the "T" of the T-shaped handle 28 is facing toward the firearm's muzzle (not shown). Push the handle fully down. In the fully down position (see FIGS. 1 and 5A), the T-shaped handle 28 fits into a mating recess 30 in the stock end 19 and is flush with the top of the stock.

To remove the stock 12 from the shotgun, pull the locking pin 20 fully up out of stock recess 30. Turn the handle 28 by 90° either clockwise or counterclockwise (see FIG. 3). Pull the stock 12 straight back off the adaptor assembly 16 (i.e., the adaptor base 18). To swap in or substitute another stock (not shown), having similar internal splines, push the substitute stock onto the adaptor base 18. While maintaining forward pressure on the substitute stock, turn the T-shaped handle 28 of locking pin 20 back, until the vertical stem of its "T" faces toward the firearm's muzzle (see FIG. 2). Push the pin handle 28 fully down (see FIG. 1).

FIGS. 4 and 5 show perspective views of the preferred stock 12 and adaptor assembly 16 with the stock 12 removed. The adaptor base 18 has a slightly conical support shaft 32 with the external splines 24. The stock 12 has a matching conical pocket 34 with the internal splines 26. When the stock 12 is slid over the adaptor base 18, their splines interlock and prevent rotational movement between the stock 12 and the adaptor base 18. The conical mating surfaces work in conjunction with the splines to prevent side-to-side and vertical movement.

Locking pin 20, in the preferred adaptor assembly 16, includes a generally cylindrical pin 36 with two opposing "top" flats 38*a*, 38*b* (see FIG. 7B) milled adjacent its top end; and two opposing "bottom" flats 40*a*, 40*b* milled adjacent its bottom end. See FIGS. 6 and 7.

Stock 12 has holes 44, 46 and slots 48, 50 which cooperate with the cylindrical pin 36. Those holes and slots pass through and are perpendicular to the splined pocket 40.

Hole 44 and slot 48 define a top keyhole though stock 12 and splined pocket 40. Hole 46 and slot 50 define a bottom keyhole.

When the T-shaped handle 28 is turned by 90° (see FIGS. 5 and 7), top flats 38*a*, 38*b* are aligned with hole 44 and slot 48 in stock 12; and bottom flats 40*a*, 40*b* are aligned with keyhole 46 and slot 50. As the stock 12 slides onto the adaptor 16 (see FIG. 3), the top flats 38*a*, 38*b* pass through keyhole 46 and slot 50; and the bottom flats 40*a*, 40*b* pass through keyhole 46 and slot 50. When the stock is pushed fully forward, the locking pin 20 is located within holes 44, 46.

When the T-shaped handle 28 is then rotated back by 90° (see FIG. 2), this brings the flats 38*a*, 38*b* and 40*a*, 40*b* out of alignment with the slots 48, 50 in the stock 12. The stock can no longer slide over the locking pin and is retained on the adaptor base 18. Upon the T -shaped handle 28 being pushed down totally (see FIG. 1), the handle seats in the mating recess 30 atop the stock 12, which prevents the handle from rotating. A detent or snap ring 52 holds the handle, and straight pin 36, in place (see FIGS. 7A and 8A).

The clearances between the adaptor assembly 16 and stock 12 are minimal when the stock is mounted to the adaptor base 18. As the stock 12 is pushed forward on the adaptor and locked in place, its non-butt end 19 compresses an O-ring 54 (see FIG. 6). This eliminates any motion due to the minimal clearances between the stock and adaptor base.

FIGS. 6 and 7 shows an exploded view of the adaptor assembly 16. The locking pin 20 is secured to the receiver 14 with a cap screw 56. A lock washer 58 prevents the screw 56 from backing out. The locking pin 20 passes through a hole 60 atop the splined shaft of adaptor base 18, perpendicular to the longitudinal axis of adaptor 16, and is held in place by a cross pin 62. The cross pin 62 engages an annular outer groove 64 in locking pin 20. This constrains the locking pin 20 in the vertical direction (up and down) while allowing it to rotate freely.

As best shown in FIGS. 7, 7A, 8 and 8A, the locking pin/actuator means 20 includes: the T-shaped handle 28; a hexagonal shaft 66 integral with the bottom of handle 28; the generally cylindrical pin 36; a generally retainer 68; detent or snap ring 52; and retaining screw 70. The hexagonal shaft 66 passes through an internal hex 72 of a central throughbore (not fully shown) in cylindrical pin 36.

Cylindrical retainer 68 is secured to the bottom of the locking pin's hexagonal shaft 66 with retaining screw 70. The screw 70 is accessed through the hollow bottom of the cylindrical pin 36. Retainer 68 has an annular outer groove 74 which retains the snap ring 52. When the locking pin 20 is in the down position, the snap ring 52 snaps into a shallow annular inner groove at 76 inside the throughbore of cylindrical pin 36. This forms a detent for holding the locking pin 20 in the down position. When the locking pin is in the up position, the snap ring 52 provides frictional drag on hexagonal shaft 66. Since the hexagonal shaft 66 is attached to the locking pin's handle 28, this drag holds the locking pin 20 in the up position. The retainer 68 can not pass through an upper end of the internal hex 72, since the retainer is larger than the hex opening, and thus limits the upward travel of locking pin 20.

Applicants' "Easy Connect Stock" invention can also be thought of as a method of substituting a stock in a long gun, such as a shotgun. The preferred embodiment comprises the following steps: (a) attaching an adaptor assembly to a receiver assembly of a long gun; (b) removably attaching an initial stock to an adaptor base of the adaptor assembly to interconnect the stock to the receiver assembly; (c) lifting a locking pin, without the use of tools, to unlock the adaptor assembly; (d) rotating the locking pin about its longitudinal axis, without the use of tools, from an original orientation; (e) removing the stock from the unlocked adaptor assembly; (f) mounting a substitute stock onto the adaptor base; (g) rotating the locking pin back to its original orientation; (h) pressing or pushing down the locking pin to lock the adaptor base and substitute stock together and thereby interconnect the substitute stock to the receiver assembly; and, (i) during steps (a)-(h), retaining the locking pin always within the adaptor base. Note that, during steps (c)-(f), the locking pins is not released entirely from the adaptor base. This inherently prevents the locking pin from being lost in the field.

Step (h) can further comprise: pressing or pushing down the locking pin until its handle sits within a mating recess atop the stock The preferred method can also include the following steps for locking a stock onto the adaptor base: aligning a keyed shaft of the locking pin with a complementarily shaped keyhole in the stock; and pushing down the keyed shaft through the keyhole until a snap ring acts upon a group in the shaft to retain the locking pin in place.

Similarly, the preferred method can also include the following steps for unlocking a stock: lifting up the keyed shaft, out of the keyhole, and then rotating the keyed shaft to free the stock for movement off the adaptor base.

Applicants' method can also be thought of as a means for removably attaching a stock or grip to a forend in a long gun, such as a shotgun. The preferred method, which is a culled version of the preceding paragraph, comprises: (a) fixedly attaching an adaptor assembly to a receiver assembly of a long gun; (b) lifting a locking pin by a handle, without the use of tools, to unlock the adaptor assembly; (c) mounting a stock onto the adaptor base; (d) rotating the locking pin back to its original orientation; (e) pressing or pushing down the locking pin until its handle sits within a mating recess atop the stock to lock the adaptor base and stock together and thereby interconnect the stock to the receiver assembly; and, (f) during steps (a)-(e), retaining the locking pin always within the adaptor assembly. Note that, during steps (b)-(c), the locking pin is not released entirely from the adaptor base. This inherently prevents the locking pin from being lost in the field.

Applicants' invention has been described above as being useful for swapping a different stock. It can also be used to swap out a receiver assembly but keep the existing stock. After the adaptor assembly is unlocked and the existing stock is dismounted or removed, a different receiver assembly with an identical adaptor assembly can be attached to the same stock.

It should be understood that obvious structural modifications can be made without departing from the spirit or scope of the invention. For example, the spline portion of the stock can be created by shaping the stock itself or by a mechanical attachment to a modified stock. Also, different matching shapes, such as irregular polygons in cross-section, can be used rather than splines to create a mechanical attachment. An "irregular polygon" is a polygon whose sides are not all the same length or whose interior angles do not all have the same measure.

The invention claimed is:

1. A method of substituting a stock in a long gun comprising the following steps:

a. attaching an adaptor assembly to a receiver assembly of a long gun;

b. removably attaching an initial stock to an adaptor base of the adaptor assembly to interconnect the stock to the receiver assembly;

c. unlocking the adaptor base from the initial stock by:

i. lifting a locking pin, located within the adaptor base, without the use of tools;

ii. rotating the locking pin, from an initial orientation, without the use of tools;

d. removing the initial stock from the unlocked adaptor base;

e. mounting a substitute stock onto the adaptor base;

f. locking the substitute stock and adaptor base together by:

i. rotating the locking pin back to its original orientation without the use of tools;

ii. pushing back down the locking pin to interconnect the substitute stock to the receiver assembly; and g. during steps (a)-(f), retaining the locking pin always within the adaptor base.

2. The method of claim 1 wherein step (f)(ii) further comprises pushing down the locking pin into a mating recess within the substitute stock.

3. The method of claim 1 wherein step (c)(ii) further comprises rotating the locking pin until two opposing flats on the locking pin align with a keyhole in the stock.

4. The method of claim 1 wherein the long gun is a shotgun.

5. A method of substituting a stock in a long gun comprising the following steps:

a. fixedly attaching an adaptor assembly to a receiver assembly of a long gun;

b. removably attaching an initial stock to an adaptor base of the adaptor assembly to interconnect the stock to the receiver assembly;

c. unlocking the adaptor base from the initial stock by:

i. lifting a locking pin, located within the adaptor base, without the use of tools;

ii. rotating the locking pin, without the use of tools, from an initial orientation of the locking pin until a keyed shaft of the locking pin is aligned with at least one complementarily shaped keyhole in the initial stock;

d. removing the initial stock from the unlocked adaptor assembly;

e. mounting the adaptor base onto a substitute stock;

f. rotating the locking pin back to its initial orientation;

g. pushing down the locking pin into a mating recess within the substitute stock to lock the adaptor assembly and thereby interconnect the substitute stock to the receiver assembly; and h. during steps (a)-(h), retaining the locking pin always within the adaptor base.

6. The method of claim 5 wherein step (f) further comprises a spline connection.

7. The method of claim 6 wherein the long gun is a shotgun.

8. A method comprising:

a. attaching an adaptor assembly to a receiver assembly of a long gun;

b. removably attaching a stock to an adaptor base of the adaptor assembly to interconnect the stock to the receiver assembly;

c. unlocking the adaptor base from the stock by:

i. lifting a locking pin, located within the adaptor base, from an initial position without the use of tools;

ii. rotating the locking pin, without the use of tools, by 90° along its longitudinal axis;

d. removing the stock from the unlocked adaptor base; and e. during steps (a)-(d), retaining the locking pin always within the adaptor assembly.

9. The method of claim 8 wherein step c(ii) further comprises rotating the locking pin until two opposing flats on the locking pin align with a keyhole in the stock.

10. A method comprising:

a. fixedly attaching an adaptor assembly to a receiver assembly of a long gun;

b. unlocking an adaptor base of the adaptor assembly by:

i. lifting a locking pin, located within the adaptor base, without the use of tools;

ii. rotating a locking pin, located within the adaptor base, along a longitudinal axis of the locking pin by 90°, without the use of tools, from an initial orientation until at least one set of opposing flats of the locking pin is aligned with at least one complementarily shaped keyhole in an adjacent stock;

c. mounting the stock onto the adaptor base;

d. rotating the locking pin back 90° to its initial orientation;

e. pressing or pushing down the locking pin until the handle sits within a mating recess atop the stock to lock the adaptor base and stock together and thereby interconnect the stock to the receiver assembly; and f. during steps (a)-(e), retaining the locking pin always within the adaptor assembly.

* * * * *